US011326289B2

(12) United States Patent
Debaes et al.

(10) Patent No.: US 11,326,289 B2
(45) Date of Patent: May 10, 2022

(54) TUFTING MACHINE, METHOD OF TUFTING A FABRIC, AND TUFTED FABRIC

(71) Applicant: VANDEWIELE NV, Kortrijk/Marke (BE)

(72) Inventors: Steven Debaes, Rekkem (BE); Koen Callewaert, Tielt (BE)

(73) Assignee: VANDEWIELE NV, Kortrijk/Marke (BE)

( * ) Notice: Subject to any disclaimer, the term of this patent is extended or adjusted under 35 U.S.C. 154(b) by 144 days.

(21) Appl. No.: 16/477,056

(22) PCT Filed: Dec. 19, 2017

(86) PCT No.: PCT/EP2017/083480
§ 371 (c)(1),
(2) Date: Jul. 10, 2019

(87) PCT Pub. No.: WO2018/130386
PCT Pub. Date: Jul. 19, 2018

(65) Prior Publication Data

US 2019/0330777 A1 Oct. 31, 2019

(30) Foreign Application Priority Data

Jan. 12, 2017 (EP) ..... 17151158

(51) Int. Cl.
*D05C 15/30* (2006.01)
*D05C 15/10* (2006.01)
(Continued)

(52) U.S. Cl.
CPC ..... *D05C 15/30* (2013.01); *D05C 15/10* (2013.01); *D05C 15/34* (2013.01); *D05C 15/24* (2013.01)

(58) Field of Classification Search
CPC ..... D05C 15/30; D05C 15/10; D05C 15/34; D05C 15/26
See application file for complete search history.

(56) References Cited

U.S. PATENT DOCUMENTS 3,338,198 A 8/1967 Short et al.
3,964,411 A * 6/1976 Smith ..... D05C 15/28 112/410

(Continued)

FOREIGN PATENT DOCUMENTS

EP 2048273 A1 * 4/2009 ..... D05C 15/10
WO 2013016314 1/2013

OTHER PUBLICATIONS

Written Opinion and International Search Report of PCT/EP2017/083480 dated Feb. 26, 2018, 15 pages.

(Continued)

*Primary Examiner* — Alissa L Hoey
*Assistant Examiner* — Patrick J. Lynch
(74) *Attorney, Agent, or Firm* — Rankin, Hill & Clark LLP

(57) ABSTRACT

A tufting machine (100) comprises a needle bar (10) shiftable in a needle bar longitudinal direction (L), a plurality of needles (12) being provided on the needle bar (10) following each other in the needle bar longitudinal direction (L), each needle (12) being individually selectable for carrying out a stitch and thereby generating a pile on a backing fabric, further comprising such a yarn threading that, on the needle bar (10), groups (G) of the needles (12) following each other in the needle bar longitudinal direction (L) and comprising a predetermined number of needles (12) are generated, the needles (12) of each group (G) having yarns of different properties threaded therethrough, the number of yarns of different properties associated with each group (G) being less than the number of needles (12) within each group (G), (Continued)

such that, within each group (G), at least two needles (12) have yarns of the same property threaded therethrough.

8 Claims, 3 Drawing Sheets

(51) Int. Cl.
*D05C 15/34* (2006.01)
*D05C 15/24* (2006.01)

(56) References Cited

U.S. PATENT DOCUMENTS 5,392,723 A 2/1995 Kaju
5,461,996 A * 10/1995 Kaju ..... D05C 15/26 112/475.19
5,738,030 A * 4/1998 Ok ..... D05C 15/26 112/475.23
6,228,460 B1 * 5/2001 Hamilton ..... D05C 15/34 112/80.01
6,895,877 B1 5/2005 Weiner
7,222,576 B2 * 5/2007 Kilgore ..... D05C 15/22 112/80.5
8,240,263 B1 * 8/2012 Frost ..... D05C 15/30 112/475.23
2009/0260554 A1 * 10/2009 Hall ..... D05C 15/34 112/80.4
2013/0025518 A1 * 1/2013 Machell-Archer .... D05C 15/34 112/475.23
2014/0283724 A1 * 9/2014 Frost ..... D05C 15/30 112/475.23
2017/0096757 A1 * 4/2017 Hall ..... D05C 15/34

OTHER PUBLICATIONS

European Office Action of EP Serial No. 17826486.7 dated Jan. 20, 2022, 8 pages.

* cited by examiner

TUFTING MACHINE, METHOD OF TUFTING A FABRIC, AND TUFTED FABRIC

The present invention relates to a tufting machine, a method of tufting a fabric, and a tufted fabric.

From U.S. Pat. No. 5,392,723 a tufting machine is known having a needle bar shiftable in a needle bar longitudinal direction and having a plurality of needles arranged thereon following each other in the needle bar longitudinal direction with an equal spacing between immediately adjacent needles. The needles provided on the needle bar are individually selectable for carrying out stitches at particular pile locations at which a pile is to be generated on a backing fabric movable with respect to the needle bar in a working direction which is substantially perpendicular with respect to the needle bar longitudinal direction. Groups of needles are provided having yarns of different colors threaded therethrough. These groups are arranged following each other in the needle bar longitudinal direction. The number of needles within each group and the number of differently colored yarns associated with the needles, respectively, define a repeat of the yarn threading. For being able to provide a pile of each color at each pile location, the needle bar is shiftable in such an extent that each needle can be positioned in a number of different positionings, each positioning corresponding to a row of piles to be tufted, equal to the number of needles and differently colored yarns, respectively, within each group. While, with a needle bar having such a yarn threading with a repeatedly appearing sequence of differently colored yarns threaded therethrough, a colorful tufted fabric may be produced with a wide variety of patterns, an increase of the pile density requires the provision of an increased number of lines of piles for providing a correspondingly increased number of pile locations where such additional piles can be tufted.

DE 103 06 601 B4 discloses a tufting machine having modules of needles arranged on a needle bar, the modules following each other in the needle bar longitudinal direction. Within each module, a plurality of needles are arranged such that each needle can be individually selected for carrying out a stitch at a pile location where a pile is to be generated on a backing fabric.

It is an object of the present invention to provide a tufting machine and a method of tufting a fabric, in particular a carpet, by means of which a fabric having a pronounced appearance of yarns with at least one yarn property can be tufted. It is a further object of the present invention to provide a tufted fabric, in particular a carpet, having a pronounced appearance of yarns with at least one yarn property.

According to a first aspect of the present invention, this object is achieved by a tufting machine comprising a needle bar shiftable in a needle bar longitudinal direction, a plurality of needles being provided on the needle bar following each other in the needle bar longitudinal direction, each needle being individually selectable for carrying out a stitch and thereby generating a pile on a backing fabric, further comprising such a yarn threading that, on the needle bar, groups of the needles following each other in the needle bar longitudinal direction and comprising a predetermined number of needles are generated, the needles of each group having yarns of different properties threaded therethrough, the number of yarns of different properties associated with each group being less than the number of needles within each group, such that, within each group, at least two needles have yarns of the same property threaded therethrough.

By means of providing such a yarn threading on a tufting machine having at least one property twice within each group, the optical appearance of such a property can be emphasized, for example, by generating piles with yarns having the same property with a higher density on a backing fabric and/or by generating two piles with yarns having the same property at the same pile location. Therefore, an increased pile density can be obtained without the necessity of increasing the number of pile locations and, therefore, without the necessity of introducing additional movements of the needle bar, for example, for tufting piles at additional pile locations in additional lines of piles. The working speed can be increased thereby, while the waste of yarn not used for providing piles is substantially reduced.

The yarn threading of the tufting machine according to the present invention may be such that:

$$N_P = N_N - A,$$

wherein:

$N_P$ is the number of different properties of the yarns threaded through the needles of each group, $N_N$ is the number of needles of each group, A is an integer in the range from 1 to $N_N/2$.

With such a yarn threading, up to half of all the yarns associated with the needles of each group may have the same property.

For allowing easy control of the needle bar during the tufting process, a sequence of yarns within the groups may be the same for the majority of groups, preferably all groups.

Further, within at least one group, preferably within the majority of groups, most preferably within each group yarns, needles having yarns of the same property threaded therethrough may not be positioned immediately adjacent to each other in the needle bar longitudinal direction, and/or, at at least one transition between immediately adjacent groups, a needle associated with one of the groups and a needle associated with the other one of the groups may have yarns of different properties threaded therethrough.

For allowing the positioning of all the needles of each group such that each needle can be positioned in alignment with a particular row of piles that is to be generated with the needles and the yarns of this group, respectively, in the tufting machine according to the present invention, the needles may be arranged on the needle bar with a substantially uniform distance between immediately adjacent needles in the needle bar longitudinal direction, and the needle bar may be shiftable in the needle bar longitudinal direction with a minimum extent of movement fulfilling the requirement:

$$E \geq D \times (N_N - 1)$$

wherein:

E is the minimum extent of movement of the needle bar in the needle bar longitudinal direction, D is the distance between immediately adjacent needles in the needle bar longitudinal direction, $N_N$ is the number of needles within each group.

With such a minimum extent of movement of the needle bar in the needle bar longitudinal direction, the needle bar can be positioned at least in a number of different needle bar positionings corresponding to the number of equally spaced needles within each group.

For allowing the use of a so-called chisel technique, the minimum extent of movement of the needle bar in the needle bar longitudinal direction may fulfill the requirement:

$$E \geq D \times N_N.$$

The property may define the yarn color and/or the yarn material and/or the yarn structure.

According to another aspect of the present invention, the object is achieved by a method of tufting a fabric, in particular carpet, by using a tufting machine having a needle bar shiftable in a needle bar longitudinal direction, a plurality of needles being provided on the needle bar following each other in the needle bar longitudinal direction, each needle being individually selectable for carrying out a stitch and thereby generating a pile on a backing fabric movable in a working direction of the tufting machine, the method comprising generating a plurality of rows of piles extending substantially in the working direction and lines of piles extending substantially in the needle bar longitudinal direction and substantially perpendicular with respect to the working direction, each intersection of the rows of piles and the lines of piles defining a pile location where a pile is or can be generated on the backing fabric, wherein, at at least one pile location, at least two piles, preferably two piles, which means exactly two piles, are generated by different needles.

By generating a plurality of piles at the same pile location, the appearance of the yarns used for generating these piles will be emphasized within a fabric tufted with such a method.

According to a very advantageous aspect of the method according to the present invention, during generating the piles of one line of piles, the backing fabric is not moved in the working direction, preferably wherein, after this line of piles has been generated, the backing fabric is moved in the working direction by a distance corresponding to the distance between two lines of piles immediately adjacent to each other in the working direction. By not moving the backing fabric during generating one line of piles, it can be ascertained that, at pile locations where a plurality of piles are to be generated, all these piles will be generated at exactly the same position within a pile location on the backing fabric.

Preferably, the method of the present invention is carried out by using a tufting machine of the present invention.

For generating two piles at the same pile location by using different needles, a first needle having a yarn threaded therethrough may be positioned at this pile location and a first pile may be generated by penetrating the backing fabric with the first needle, and, after having generated the first pile, a second needle having a yarn threaded therethrough may be positioned at this pile location and a second pile may be generated by penetrating the backing fabric with the second needle.

For emphasizing the optical appearance of a particular property, the yarn threaded through the first needle and the yarn threaded through the second needle may have the same property. The property may define the yarn color and/or the yarn material and/or the yarn structure.

According to another advantageous aspect of the present invention, the yarn threaded through the first needle and the yarn threaded through the second needle may have different properties. Again, the property may define the yarn color and/or the yarn material and/or the yarn structure. The use of yarns having different properties for generating piles at one and the same pile location allows the generation of a property mixing effect which, due to the increased pile density, will be very intensive.

In association with at least a part of the rows of piles, the first needle and the second needle may be associated with the same group, and/or, in association with at least a part of the rows of piles, the first needle and the second needle may be associated with different groups.

The variety of the patterns provided on a fabric tufted with the method of the present invention may be increased by generating two piles at a pile location in association with the least a part of the pile locations, and/or by generating one pile at a pile location in association with a part of the pile locations, and/or by not generating a pile in association with a part of the pile locations. Further, according to a very advantageous aspect of the present invention, in association with each pile location the number of piles to be generated can be selected to be any number of piles in the range of 0 piles to a maximum number of piles, preferably two piles.

The present invention further relates to a tufted fabric, in particular carpet, comprising a backing fabric and a plurality of piles provided at pile locations on the backing fabric, wherein, at at least one pile location, preferably a plurality of pile locations, at least two piles are provided. Such a fabric can preferably be made by using a tufting machine and/or a method of tufting a fabric according to the present invention.

It is to be noted that such piles may be cut piles providing two pile legs, such that, at pile locations having, for example, two piles therein, there may be four pile legs. If the yarns threaded through the needles are slightly clamped to the needles, after having generated a cut pile with two pile legs, the pile leg still connected to the remainder of the yarn threaded through the needle might become drawn out of the backing fabric, such that, at such a pile location, there will remain three pile legs. This will in particular occur in situations, in which there is a greater distance between this last pile and the next pile to be generated with the same needle at another pile location, what leads to a substantial reduction in pile consumption, as the distance between these two separated pile locations will not be bridged by a portion of this yarn extending at the backside of the backing fabric.

Further, the piles may be loop piles, such that, at a pile location having two piles, there will be two loops of yarn.

In such a fabric, the piles preferably are arranged in rows of piles extending substantially in a working direction of a tufting machine and lines of piles substantially perpendicular with respect to the rows of piles and substantially extending in a longitudinal direction of a needle bar used for generating these lines of piles, each pile location being provided at an intersection of a row of piles with a line of piles.

In the fabric according to the present invention, at at least one pile location having at least two piles provided therein, preferably at the majority of pile locations having at least two piles provided therein, most preferably at each pile location having at least two piles provided therein, the piles of such a pile location may be made of yarns having the same property, preferably wherein the property defines the yarn color and/or the yarn material and/or the yarn structure. Therefore, in areas with a plurality of such pile locations having at least two piles, the property of the yarns used for providing this piles is emphasized.

Further, at at least one pile location having at least two piles provided therein, preferably at the majority of pile locations having at least two piles provided therein, most preferably at each pile location having at least two piles provided therein, piles of such a pile location are made of yarns having different properties. Again, the properties may define the yarn color and/or the yarn material and/or the yarn structure. This allows the generation of the property mixing effect which, for example, may be used for providing a very smooth transition from an area in which yarns having the one property are used to an area in which yarns having the other property used via a transition area in which yarns having the one property as well as yarns having the other property are used. In all these areas, the properties of the yarns used additionally will be emphasized by providing pile locations having at least two piles therein.

At at least one pile location a single pile may be provided, and/or at at least one pile location no pile may be provided.

For more clearly distinguishing areas of pile locations with a plurality of piles and area of pile locations with single piles, according to a further aspect of the present invention, an area of pile locations having at least two piles provided therein may be separated from an area of pile locations having a single pile provided therein by an area of pile locations having no pile provided therein.

The present invention will now be explained with respect to the drawings, in which.

Before the present invention will be explained with reference to FIGS. 1 to 4, it is to be noted that a tufting machine according to the principles of the present invention may have a mechanical construction which, for example, may be such as disclosed in U.S. Pat. No. 5,392,723 or in DE 103 06 601 B4. To briefly summarize this mechanical construction, it is to be noted that such a tufting machine has a needle bar shiftable in a needle bar longitudinal direction which is substantially perpendicular with respect to the working direction of such a tufting machine, which is the direction in which a backing fabric is to be moved during tufting a fabric. A plurality of needles are arranged on such a needle bar with an equal spacing therebetween and such that each one of the needles can be individually selected for making a stitch during a particular tufting cycle, while all the other needles, or at least a part thereof, are deactivated and do not move for penetrating the backing fabric and thereby generating a pile. Further, in association with each row of pile to be generated such as to substantially extend in the working direction, a looper is provided underneath the backing fabric for holding a yarn threaded through a needle penetrating the backing fabric and thereby generating a loop which can then be cut for providing cut piles.

Figure 1:
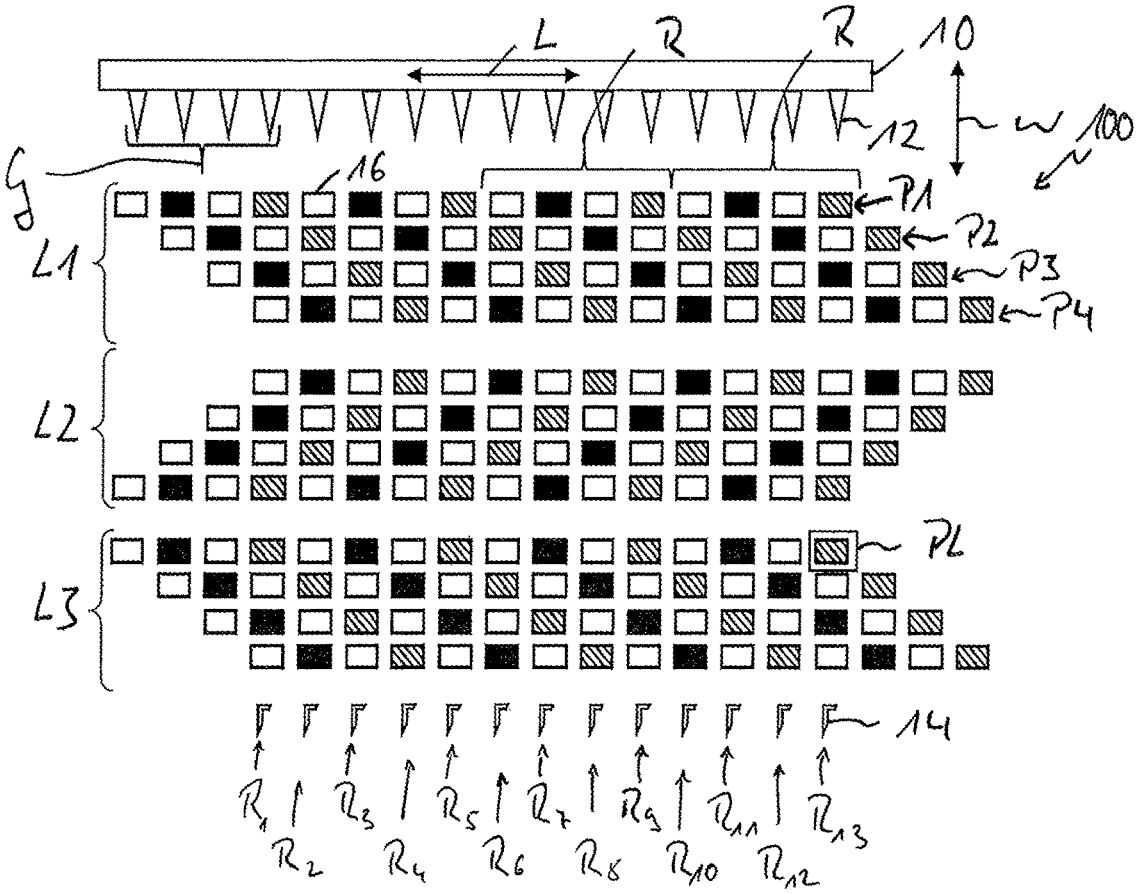
FIG. 1 is a schematic view of a shiftable needle bar and the yarn threading associated with this needle bar.

A needle bar 10 of such a tufting machine 100 is shown in the schematic view of FIG. 1 having a plurality of needles 12 with equal spacing therebetween arranged following one another in the needle bar longitudinal direction L. The backing fabric that is not shown in FIG. 1 is movable in a working direction W with respect to the needle bar 10, which working direction W is substantially perpendicular with respect to the needle bar longitudinal direction.

In the arrangement shown in FIG. 1, needle bar 10 is shiftable in the needle bar longitudinal direction L such as to be positioned in four different positionings P1, P2, P3, and P4.

In association with each row of piles R1-R13 to be generated by such a tufting machine, a looper 14 is provided for generating a loop with a yarn threaded through one of the needles 12 penetrating the non-shown backing fabric during a particular tufting cycle and optionally cutting this loop.

FIG. 1 further shows the four positionings P1-P4 of needle bar 10 in association with three lines of piles L1, L2, L3 to be generated one after the other during the tufting process. For generating each line of piles L1, L2, L3, four tufting cycles may be used, each tufting cycle being defined by one of the four positionings P1-P4 of needle bar 10.

Each one of the differently colored rectangles 16 indicates a yarn threaded through one of needles 12 of needle bar 10. Each color of rectangles 16 indicates a particular property of such a yarn, which property, for example, may be the yarn color. As can be seen in FIG. 1, yarns of three different properties, for example, three different colors, are used and are arranged such that a repeat R of the yarn threading is defined. Within each such repeat, the sequence of yarns of different properties is the same.

In association with the repeat R of the yarn threading, groups G of needles 12 are defined, each group G comprising needles 12 having the yarns of one repeat R threaded therethrough. This means that, for example, starting from the left end of needle bar 10 in FIG. 1, a white yarn may be threaded through first needle 12, a black yarn may be threaded through second needle 12, a white yarn may be threaded through third needle 12, and a gray yarn may be threaded through fourth needle 12. This association of repeats R of yarns with needles 12 of needle bar 10 is repeated such that there is a sequence of groups G of needles 12 following each other in the needle bar longitudinal direction L. Within each such group G, the sequence of yarns and the sequence of yarn properties, respectively, is identical.

What can further be seen in FIG. 1 is that, within each repeat R, and therefore within each group G of needles 12, one property, i.e., for example, one color, is present twice. In the example shown, there may be two white yarns within each repeat R and each group G, respectively, such that the number of different properties, i.e. different colors, is three within each repeat R comprising four yarns and within each group G comprising four needles 12, respectively. Further, FIG. 1 shows that, within each such repeat R and group G, respectively, the yarns having the same property are not positioned immediately adjacent to each other and that, at each transition between two repeats R and groups G, respectively, the yarns associated with these different repeats R and groups G, respectively, have different properties.

By moving needle bar 10 during generating each one of lines L1, L2, L3 to its four possible positionings P1, P2, P3, P4, each of the yarns associated with the needles 12 of one group G can be aligned with at least one and up to four different rows R of piles to be generated on the backing fabric. For example, the four yarns associated with group G of needles 12 shown on the left end portion of needle bar 10 in FIG. 1 will be positioned in association with rows R1-R4 such that each one of the yarns associated with this group G can be used for generating a pile in at least one of these four rows R1-R4.

FIG. 1 further shows that, during the four tufting cycles used for generating one line of pile L1, L2, L3, the two yarns having the same property, i.e., for example, the white yarns, will be present twice in each one of the four rows. This means that, when positioning needle bar 10 during the four cycles for generating one line L1, L2, L3 in its four possible positionings P1-P4, at each pile location PL, i.e. at each location at which a pile is to be generated on the backing fabric, two piles of yarns having the same property may be generated by two different needles. If, for example, at the pile location PL being defined by the intersection of first line L1 with first row R1, two piles of yarns having the same property, i.e. of white yarns, are to be provided, during the first tufting cycle corresponding to positioning P1, no needle will be selected in association with row R1. During the second tufting cycle corresponding to positioning P2, the needle aligned with row R1 will be selected and therefore activated for penetrating the backing fabric and generating a white pile. In the third tufting cycle corresponding to positioning P3 of needle bar 10, the needle aligned with row R1 will not be selected such that no pile will be generated during this tufting cycle, while, in the fourth tufting cycle corresponding to positioning P4 of needle bar 10, needle 12 aligned with row R1 will be activated for generating a second white pile at one and the same pile location PL corresponding to the point of intersection between line L1 and row R1. During all these four cycles, at all the other pile locations associated with first line L1, piles can be generated by using yarns having the other properties or by using yarns having the same property as do the yarns used for generating piles in row R1.

By going through the four positionings P1-P4, at each pile location of line L1, i.e. in association with each one of rows R1-R13, one pile of each one of the three properties provided within each repeat R and each group G or two piles of the yarn having the property which is present twice within each repeat R and group G, respectively, can be generated. This process can be repeated when generating second line L2 by moving needle bar 10 through the four possible positionings P1-P4, but starting with positioning P4, i.e. the positioning in which needle bar 10 has been positioned in the last tufting cycle for generating first line L1.

For further enhancing the optical appearance of a fabric tufted with such a yarn threading and such a method of tufting a fabric, the backing fabric is not moved in the working direction W, while all the piles associated with one of lines L1, L2, L3 are generated. By not moving the backing fabric during generating one line of piles, it first of all is ascertained that all the piles associated with different rows R1-R10 will appear at substantially the same location in the working direction W and will not be offset with respect to each other in the working direction W. Further, at those pile locations PL where, by using yarns having the same property, a double pile is to be generated, these two piles will be positioned at exactly the same positioning on the backing fabric. After having generated the first pile at such a pile location PL and having moved needle bar 10 such that needle 12 having the yarn threaded therethrough for generating the second pile at this particular pile location PL, this needle 12 will penetrate the backing fabric at the same location as did needle 12 used for generating the first one of the two piles. There will be no offset of these piles generated in association with one and the same pile location PL in the working direction and in the needle bar longitudinal direction.

By using such a yarn threading and such a method of tufting a fabric, a fabric having such double piles at any selected pile location PL can be generated. By not selecting each one of the needles in association with one or a plurality of the pile locations of one or a plurality of lines of piles and rows of piles, pile locations having no pile generated therein can be provided. Therefore, for example, areas of double piles per pile location and areas of single piles per pile location can be separated by areas having no piles therein. Even when using only those yarns having the property which is present twice in each repeat R and group G, respectively, there will be areas of higher pile density and areas of lower pile density which are clearly optically distinguishable from each other.

Figure 2:
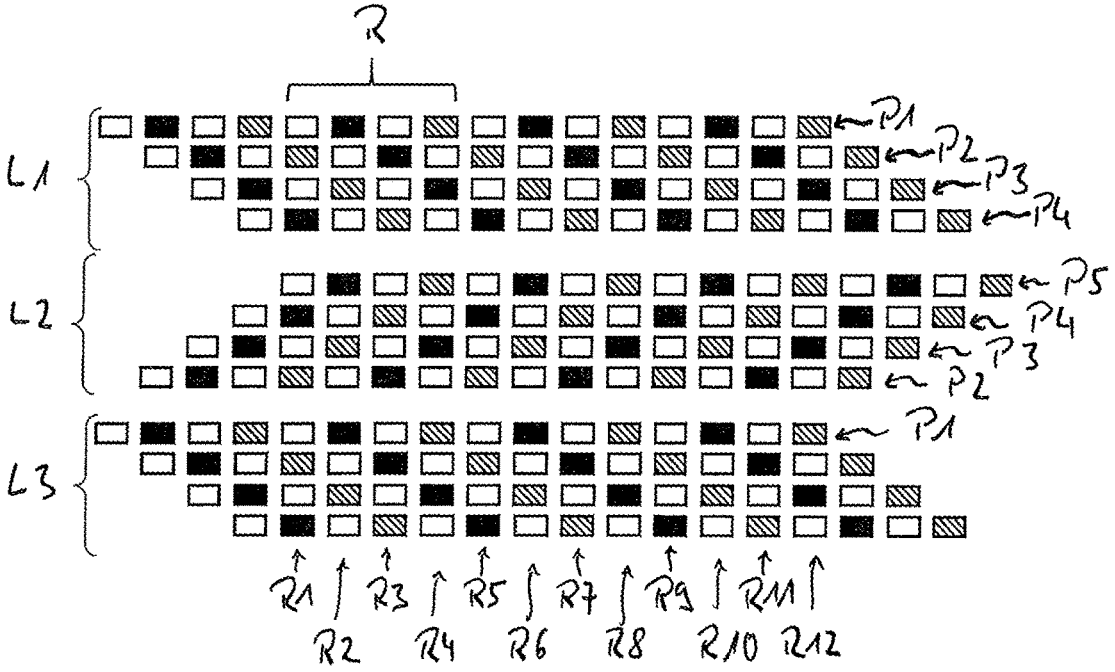
FIG. 2 is a schematic view of a needle bar having the same yarn threading as the needle bar shown in FIG. 1 but being movable with an increased extent of movement during a tufting process.

FIG. 2 shows an example in which the yarn threading is identical to the one shown in FIG. 1. Again, each repeat R comprises four yarns having three different properties. Contrary to the embodiment shown in FIG. 1, needle bar 10 is positionable, or is positioned, in five different positionings P1-P5. For each process of generating one of lines L1, L2, L3, only four of these five possible positionings will be used. In association with line L1, positionings P1-P4 are used, while, in association with line L2, positionings P5-P2 will be used. In association with line L3, again, positionings P1-P4 will be used, and so on.

By providing such a fifth positioning of needle bar 10, an increased overlap of the yarns associated with different groups G for generating different rows R of piles can be obtained. This so-called chisel technique prevents the generation of clearly distinguishable groups of rows R of piles provided by piles of different yarns. As can be seen, for example, in the transition from line L1 to line L2 in FIG. 2, the black yarn of the second repeat R starting from the left side can be positioned such that, in association with row R2, a pile can be generated with this yarn in line L1, while, in association with the same row R2, a pile can be generated with the black yarn of the first repeat starting from the left side in the second line L2. Therefore, piles of the same property, for example, the same color, but made of different yarns can be provided with one and the same row R of piles.

While, in the embodiment shown in FIG. 1, the minimum extent of the movement of needle bar 10 in the needle bar longitudinal direction L must be three times the distance between immediately adjacent needles 12 for allowing four different positionings P1-P4 of needle bar 10, in each positioning of needle bar 10 needles 12 being aligned with rows R of piles to be generated, in the embodiment shown in FIG. 2, the minimum extent of movement of needle bar 10 in the needle bar longitudinal direction L is four times the distance of immediately adjacent needles for allowing five positionings P1-P5 of needle bar 10. Again, in association with each one of these positioning, needles 12 have to be positioned such as to be aligned with one of rows R1-R12 in the needle bar longitudinal direction L.

Figure 3:
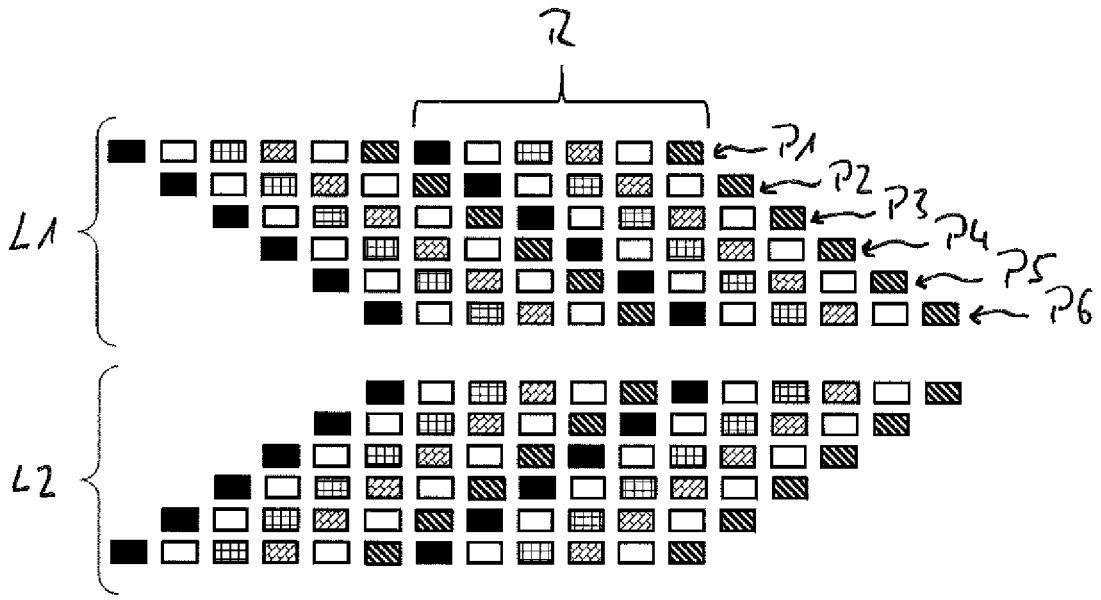
FIG. 3 is a schematic view of a needle bar having a different yarn threading.

A further example for a yarn threading is shown in FIG. 3. In this embodiment, each repeat R and correspondingly each group of needles comprises six different yarns, two of which have the same property, for example, the same color. Again, the two yarns having the same property are not positioned immediately adjacent to each other and the yarns associated with immediately adjacent needles of different repeats R and groups, respectively, have different properties. When using repeats R comprising six yarns, the needle bar must be shiftable such as to be positioned in six different positionings P1-P6. The procedure for generating each line L1, L2 therefore comprises six tufting cycles, each tufting cycle corresponding to one of the six positionings P1-P6.

Figure 4:
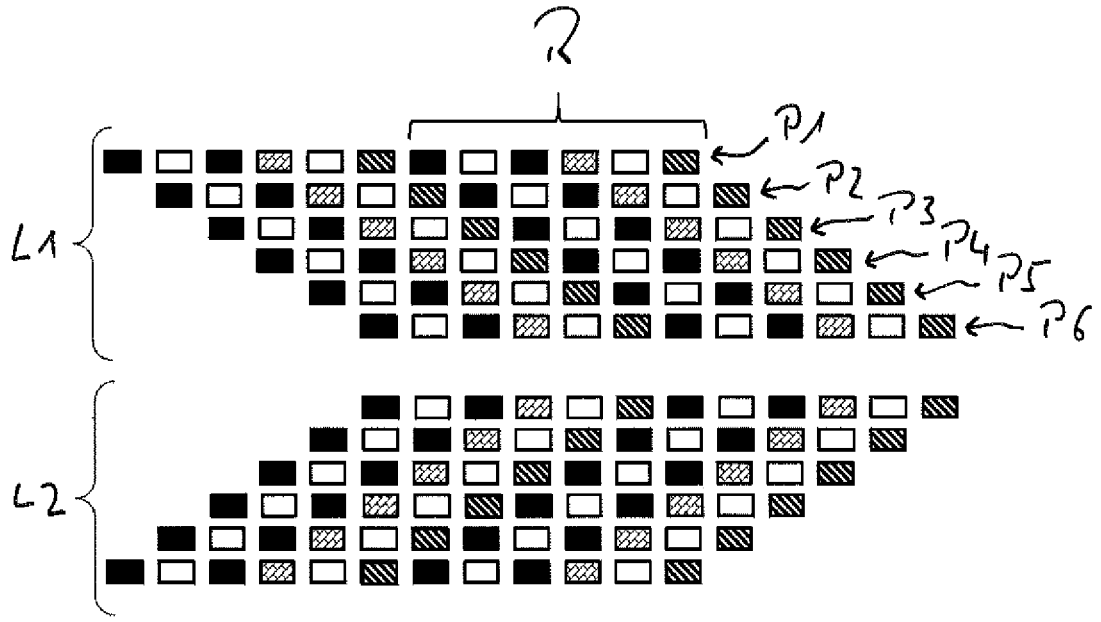
FIG. 4 is a further schematic view of a needle bar having a different yarn threading.

A further example of a different yarn threading is shown in FIG. 4. In this example, each repeat R and correspondingly each group of needles comprises six yarns. Contrary to the embodiment shown in FIG. 3, in each repeat, only four different properties, for example, four different yarn colors, are present. Two of the properties are provided twice. Again, no yarns having the same property are positioned immediately adjacent to each other and no immediately adjacent needles associated with different groups have yarns of the same property threaded therethrough.

It is to be noted that, while, in all the examples shown, all the groups of needles are provided with the same yarns and, in each group, the sequence of yarns is identical, there may be groups having other yarns threaded through the needles and/or having another sequence of the yarns. Further, the yarn threadings shown in FIGS. 1 to 4 may be used for generating fabrics with piles of different color. However, all these yarn threadings may also be used for generating fabrics having piles of only one color, but having areas of different pile densities. For generating such a fabric having piles of only one color, but having areas of different pile density by providing pile locations having at least two piles, a yarn threading with yarns of only one property, for example, one color, may be used.

Finally, it is to be noted that, while, with respect to the examples shown, yarns of different properties have been described as being yarns of different color, it is obvious that the yarns may alternatively or additionally differ in the yarn material and/or the yarn structure, in particular the surface structure of the yarns, which, for example, may either be smooth or rough.

Figure 5:
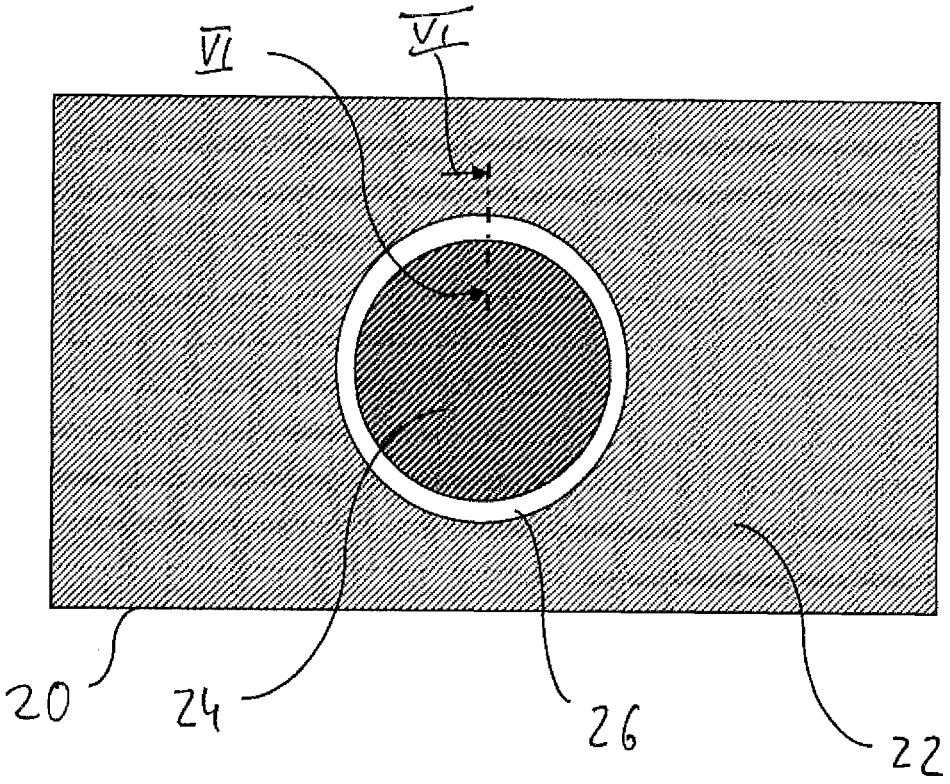
FIG. 5 shows a carpet having areas of different pile densities.

FIG. 5 shows an example of a fabric, for example, a carpet 20, tufted with a tufting machine 100 having the above described threading and a method as described above, respectively. Carpet 20 has three areas 22, 24, 26 of different pile densities. For example, area 22 may be an area in which, at each pile location PL provided within this area, a single pile PI is provided, for example, a cut pile having two pile legs or a loop pile having a closed loop of yarn. Area 24 may be an area in which, at each pile location PL provided within this area, two piles PI are provided which, again, may be cut piles, such that four pile legs are provided at each pile location, or may be loop piles, such that two closed loops of yarn are provided at each pile location PL. These areas 22, 24 are separated from one another by area 26 of pile locations with no piles provided therein.

Due to the fact that, in line with the principles of the present invention, at each pile location the number of piles to be generated can be selected without any restriction out of the possible number of piles (for example 0 piles, 1 pile, 2 piles), there are no limitations to the patterns that can be generated by varying the number of piles within the pile locations.

Figure 6:
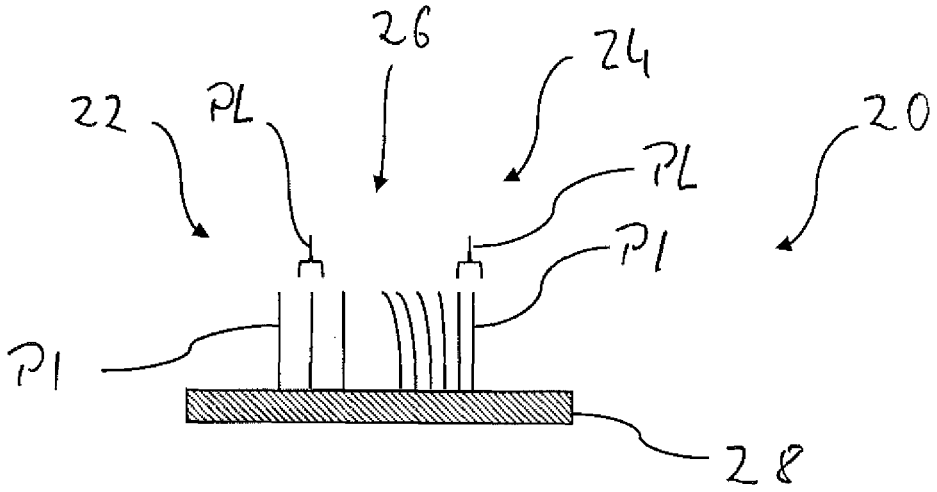
FIG. 6 is a sectional view along line VI-Vi in FIG. 5.

For example, piles PI provided within area 22 and piles PI provided within area 24 may be made of yarns having the same property which, for example, may be the yarn color. Due to the double pile density in area 24, this property, for example, the yarn color, will be much more pronounced within area 24, as is the case within area 22. Due to the provision of area 26 separating these areas 22, 24 from one another and having no piles provided therein, the difference in the optical appearance of areas 22, 24 is additionally emphasized, while, what can be seen in FIG. 6, due to the bending of piles PI at the edge of area 24 towards area 22, there will be a smooth transition between areas 22, 24.

Of course, areas 22, 24 of different pile densities may be made with yarns having different properties, for example, different colors. In this case, areas 22, 24 will not only be clearly distinguished from each other due to the different pile densities provided within these areas, but additionally will be distinguished from each other due to the different yarn properties of the yarns used for providing the piles within these areas.

According to a further aspect of the present invention, the piles generated at one and the same pile location by using different yarns and needles, respectively, may be made of yarns having different properties, for example, different colors. By using such yarns of different properties at one and the same pile location, a property mixing effect, for example, a color mixing effect can be generated. For example, a red yarn and a yellow yarn may be used for generating two piles at one and the same pile location. Due to the color mixing effect, a tufted fabric, for example, a carpet will seem to be orange at this location. Due to the increased pile density provided when generating a plurality of piles within each such pile location, this property mixing effect will be emphasized, in particular when using yarns having matching properties, as, for example, is the case with red and yellow yarns or black and white yarns.

When tufting a fabric having pile locations with a plurality of piles made of yarns having different properties and having no pile locations with a plurality of piles made of yarns having the same property, the threading of a tufting machine used for tufting such a fabric does not need the presence of at least two yarns having the same property within each group of needles. Instead, each of the needles of these groups may have a yarn of a different property threaded therethrough, such that the number of yarns having different properties may be equal to the number of needles within such a group.

Further, within one and the same fabric there may be pile locations with a plurality of piles made of yarns having the same property as well as pile locations with a plurality of piles made of yarns having different properties. For example, there may be a transition from an area in which only yarns having one property are used for providing piles, in particular double piles within each pile location, to an area in which only the yarns having an other property are used for providing piles, in particular double piles within each pile location, via a transition area in which, within each or at least a part of the pile locations, yarns having the one property as well as yarns having the other property are used for generating piles. This allows a smooth transition between these areas, while generating an effective property mixing effect in the transition area due to the use of yarns having different properties in association with an increased pile density due to providing two or a plurality of piles within each or at least a part of the pile locations.

In pile locations having more than two piles provided therein, all the piles may have different properties. Alternatively, within such a pile location, for example, two piles may be made of yarns having the same property, while at least one further pile may be made of a yarn having an other property.

Finally, it is to be noted that yarns may differ from each other in a property predominantly defining the optical appearance of such a yarn. This, for example, may be the yarn color. Of course, yarns having different properties may differ from each other in a plurality of properties, for example, the yarn color as well as the yarn structure and/or the yarn material.

The invention claimed is:

1. Method of tufting a fabric by using a tufting machine having a needle bar shiftable in a needle bar longitudinal direction, a plurality of needles being provided on the needle bar following each other in the needle bar longitudinal direction, each needle being individually selectable for carrying out a stitch and thereby generating a pile on a backing fabric movable in a working direction of the tufting machine, the tufting machine further comprising such a yarn threading that, on the needle bar, groups of the needles following each other in the needle bar longitudinal direction and comprising a predetermined number of needles are generated, the needles of each group having yarns of different colors threaded therethrough and having a same yarn threading with an identical sequence of yarns for defining a yarn threading repeat, the number of yarns of different colors associated with each group being less than the number of needles within each group, such that, within each group, at least two needles have yarns of a same color threaded therethrough, and such that, within each group, only one yarn color is employed multiple times, the method comprising generating a plurality of rows of piles extending substantially in the working direction and lines of piles extending substantially in the needle bar longitudinal direction and substantially perpendicular with respect to the working direction, each intersection of the rows of piles and the lines of piles defining a pile location where a pile is or can be generated on the backing fabric, wherein, at at least one pile location, at least two piles are generated by different needles.

2. The method according to claim 1, wherein, during generating the piles of one line of piles, the backing fabric is not moved in the working direction.

3. The method according to claim 2, wherein, after this line of piles has been generated, the backing fabric is moved in the working direction by a distance corresponding to a distance between two lines of piles immediately adjacent to each other in the working direction.

4. The method according claim 1, wherein, for generating two piles at a same pile location, a first needle having a yarn threaded therethrough is positioned at this same pile location and a first pile is generated by penetrating the backing fabric with the first needle, and, after having generated the first pile, a second needle having a yarn threaded therethrough is positioned at this same pile location and a second pile is generated by penetrating the backing fabric with the second needle.

5. The method according to claim 4, wherein the yarn threaded through the first needle and the yarn threaded through the second needle have the same color.

6. The method according to claim 4, wherein the yarn threaded through the first needle and the yarn threaded through the second needle have different colors.

7. The method according to claim 4, wherein, in association with at least a part of the rows of piles, the first needle and the second needle are associated with a same group, and/or wherein, in association with at least a part of the rows of piles, the first needle and the second needle are associated with different groups.

8. The method according to claim 1, wherein, in association with at least a part of the pile locations, two piles are generated at each one of these pile locations, and/or wherein, in association with at least a part of the pile locations, one pile is generated at each one of these pile locations, and/or wherein, in association with at least a part of the pile locations, no pile is generated.

* * * * *